United States Patent [19]

Wong

[11] Patent Number: 4,941,411

[45] Date of Patent: Jul. 17, 1990

[54] STEEL END STRUCTURE FOR ALUMINUM RAILCAR

[75] Inventor: Stephen D. Wong, Oakville, Canada

[73] Assignee: Procor Ltd., Canada

[21] Appl. No.: 317,442

[22] Filed: Mar. 1, 1989

[51] Int. Cl.[5] ..... B61D 17/00

[52] U.S. Cl. ..... 105/421; 105/410; 105/418; 105/420

[58] Field of Search ..... 105/407, 409, 410, 411, 105/416, 418, 420, 421

[56] References Cited

U.S. PATENT DOCUMENTS

| | | | |
|---|---|---|---|
| 785,781 | 3/1905 | Waggoner | 105/418 |
| 924,748 | 6/1909 | Downs | 105/418 |
| 1,771,090 | 7/1930 | Ladas | 105/416 |
| 2,219,286 | 10/1940 | Anderson et al. | 105/411 |
| 2,464,080 | 3/1949 | Hankins | 105/411 |
| 2,801,597 | 8/1957 | Ecoff | 105/407 |
| 3,145,666 | 8/1964 | Spence et al. | 105/416 |
| 3,543,692 | 12/1970 | Stark | 105/421 |
| 3,996,861 | 12/1976 | Santho | 105/409 |
| 4,082,045 | 4/1978 | McNally et al. | 105/411 |
| 4,561,361 | 12/1985 | Adams | 105/409 |
| 4,690,071 | 9/1987 | Billingsley et al. | 105/404 |
| 4,690,072 | 9/1987 | Wille et al. | 105/406.1 |
| 4,696,283 | 9/1987 | Billingsley et al. | 105/248 |

OTHER PUBLICATIONS

*Aluminum For More Efficient Railroad Cars,* Aluminum Association, Jan. 1980.

Procor Drawing No. 85083–End Sub-Assembly Covered Hooper Car, 11/10/83.

Procor Drawing No. 85087–*Body Assembly* 2900 *Cu. Ft. Aluminum Covered Hopper Car,* 8/15/83.

*Primary Examiner*—Andres Kashnikow

*Assistant Examiner*—Christopher G. Trainor

*Attorney, Agent, or Firm*—Dressler, Goldsmith, Shore, Sutker & Milnamow, Ltd.

[57] ABSTRACT

A covered hopper railcar having an aluminum body portion comprising aluminum side, top and end sheets. A side sill is secured to the lower marginal portion of each of the side sheets. The end structure assembly includes a steel center stub sill assembly, a steel shear plate, steel body bolsters, and a pair of spaced-apart steel end stiffener members. The end stiffener members extend between and are secured at their bottom ends to the upper surface of the shear plate, at their top portions to the end sheet and side sheet, and at intermediate portions to the end sheet. The top portion of the end stiffener members is secured to aluminum connector plates, which plates are secured to the end sheet and a side sheet by huckbolts passing therethrough. The intermediate portion of the end stiffener members is huckbolted to an aluminum bracket which in turn is secured to the end sheet.

17 Claims, 4 Drawing Sheets

STEEL END STRUCTURE FOR ALUMINUM RAILCAR

FIELD OF INVENTION

The invention relates to aluminum railcar construction and, more specifically, to an all-steel end structure for a railcar having an aluminum body portion.

BACKGROUND OF THE INVENTION AND TECHNICAL PROBLEMS POSED BY THE PRIOR ART

The design of aluminum railcars within the fatigue strength of welded aluminum has been a great challenge to railcar designers. It is highly desirable to use aluminum in areas for product containment, where corrosion protection is needed and to reduce the weight of the railcar, and to use higher strength steel in critical areas for sustaining coupler and vertical lading loads.

Railcars having aluminum body portions comprising side sheets, a top sheet and end sheets made from aluminum are well-known in the art. Some of such railcars utilize an expensive full-length steel center sill underframe arrangement, while others utilize steel/aluminum stub sill underframes. In the latter instance there are two primary approaches. One uses all-aluminum components, including the stub sill. The steel striker and rear draft lugs that accommodate the draft system are usually connected to the aluminum stub sill by means of two-piece fasteners. The other approach employs steel stub sills and bolsters that are fastened to aluminum shear plates and aluminum end stiffeners that are welded to the end sheets.

The prior art aluminum railcar designs are expensive to build and costly to maintain because of the high quality demanded and the use of complicated structural arrangements necessary to avoid high stresses at the welded aluminum areas. Accordingly, there is a need for a simple and more cost-effective aluminum railcar design. More specifically, there is a need for an improved connection arrangement for connecting an all-steel end structure to an aluminum railcar body.

SUMMARY OF THE INVENTION

An aluminum railcar is provided that utilizes high-strength steel in critical areas for sustaining coupler and vertical loads and aluminum for product containment where corrosion protection is needed. The invention utilizes a fabricated all-steel end structure comprising a shear plate, stub sill, body bolsters and end stiffener members. The end structure is connected to the aluminum car body primarily at two locations; namely, the side sills to the shear plates and the end stiffener members to the end and side sheets of the aluminum car body. The end stiffener members allow the stub sill and the aluminum car body to work in unison with the shear plate and bolsters in sustaining loads.

In accordance with a preferred embodiment of the invention, a covered hopper railcar is disclosed having an aluminum body portion comprising aluminum side, top and end sheets. A side sill is secured to the lower marginal portion of each of the side sheets extending lengthwise of the car and to the shear plate. The end structure assembly includes a steel center stub sill assembly, a steel shear plate, steel body bolsters, and a pair of spaced-apart steel end stiffener members. The center stub sill assembly is located generally on the longitudinal centerline of the car body and the body bolsters extend transversely of the car body intermediate the outer end of the center stub sill assembly and the ends of the side sills.

The shear plate is supported on and attached to the body bolsters and the center stub sill. The side sills are secured to the upper surface of the shear plate by fasteners passing therethrough. A pair of spaced-apart end stiffener members extends between and is secured at their bottom ends to the upper surface of the shear plate and at their top ends to the end sheet and side sheets. The end stiffener members are preferably secured at their intermediate portions to the end sheet. The end stiffener members extend downwardly and inwardly from the upper portion of the side sheets towards a portion of the shear plate above the center stub sill assembly and have a depth that increases from the top toward the bottom thereof.

In accordance with a unique feature of the invention, the top portion of the end stiffener members is secured to aluminum connector plates, that are secured to the end sheet and a side sheet, by fasteners passing therethrough. The intermediate portion of the end stiffener members is preferably fastened to an aluminum bracket which in turn is secured to the end sheet. The aluminum side sills, end sheets and side sheets are reinforced with aluminum stiffeners, pads and gussets.

The foregoing end structure construction and connections provide the necessary strength and minimize the forces exerted on the welded aluminum components in the car body, while at the same time facilitating the fabrication of both the end structures and the aluminum car body.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENT

Figure 2:
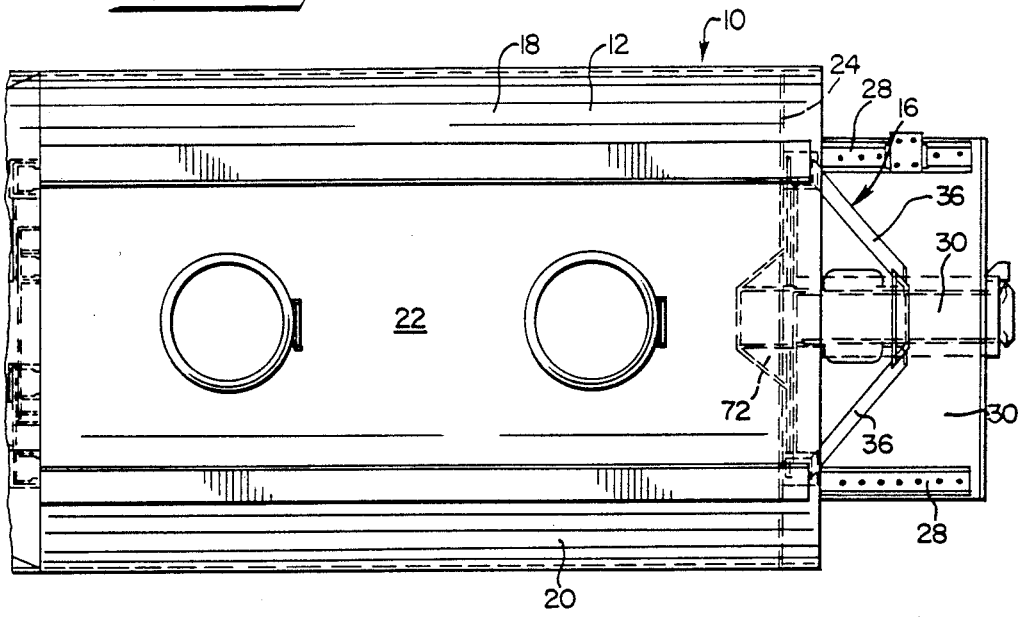
FIG. 2 is a top plan view of the railcar shown in FIG. 1.
Figure 1:
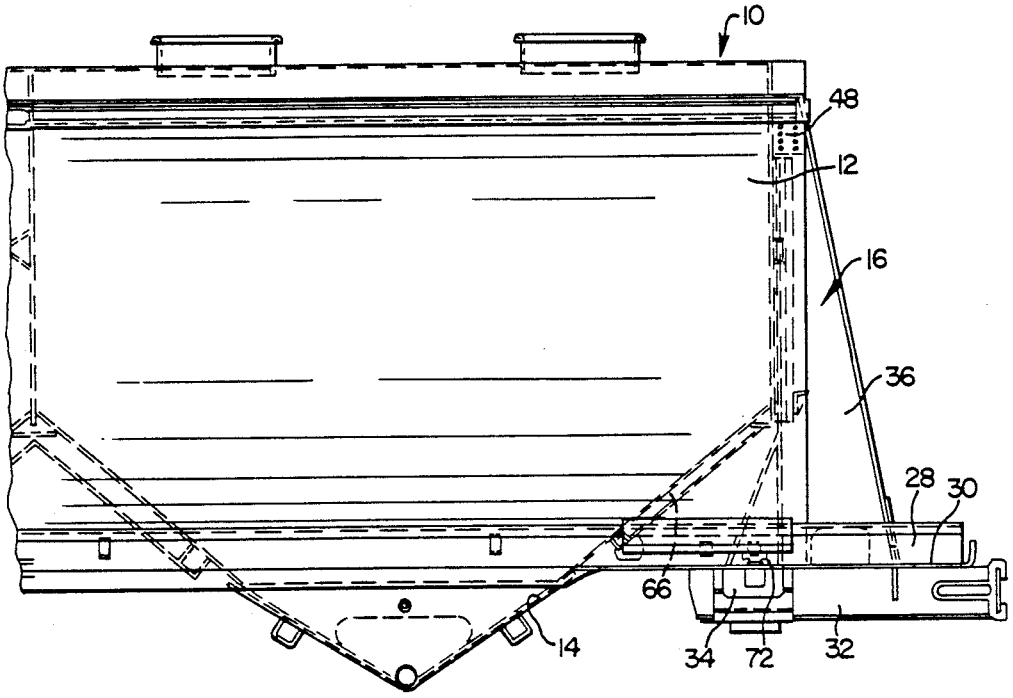
FIG. 1 is a side elevational view of an end portion of an aluminum railcar having an end structure in accordance with the invention, with certain parts removed for clarity.

While this invention is susceptible of embodiment in many different forms, the description of this invention and the accompanying drawings disclose only one specific form as an example of the use of the invention. The invention is not intended to be limited to the embodiment so described, and the scope of the invention will be pointed out in the appended claims.

Some of the figures illustrating the preferred embodiment of the apparatus show structural details and mechanical elements that will be recognized by one skilled in the art. However, the detailed descriptions of some of these elements are not necessary to an understanding of the invention and, accordingly, are not herein presented.

Referring to FIGS. 1–4, an end portion of a center stub sill covered hopper railcar 10 is shown with various components thereof, such as wheel trucks, removed for clarity. Railcar 10 includes a conventional body portion 12, defining hoppers 14 therein, having an end structural assembly 16 of the present invention at either end of the car. Only one such end structure assembly 16 is shown since the end structure is identical at each end of the car.

Car body portion 12 includes side sheets 18 and 20, top sheet 22, end sheets 24 and end slope sheets 26. Side sheets 18 and 20 and top sheet 22 extend outwardly beyond the end sheets 24. Sheets 18, 20, 22 and 24 are of aluminum construction and are attached to one another in a well-known manner so as to define body portion 12. Aluminum side sills 28 are attached to the lower marginal portions of the respective side sheets 18 and 20, with the sills extending substantially the entire length of the side sheets and beyond the outer edges thereof.

In accordance with the present invention, end structure assembly 16 of the present invention is attached to the aluminum body portion 12 in a manner that sustains the coupler and vertical lading loads and provides effective stress transfer paths to the aluminum car body. End structure assembly 16 is essentially a fabricated all-steel construction comprising a shear plate 30, a center stub sill 32, body bolsters 34, and end stiffener members 36.

Figure 4:
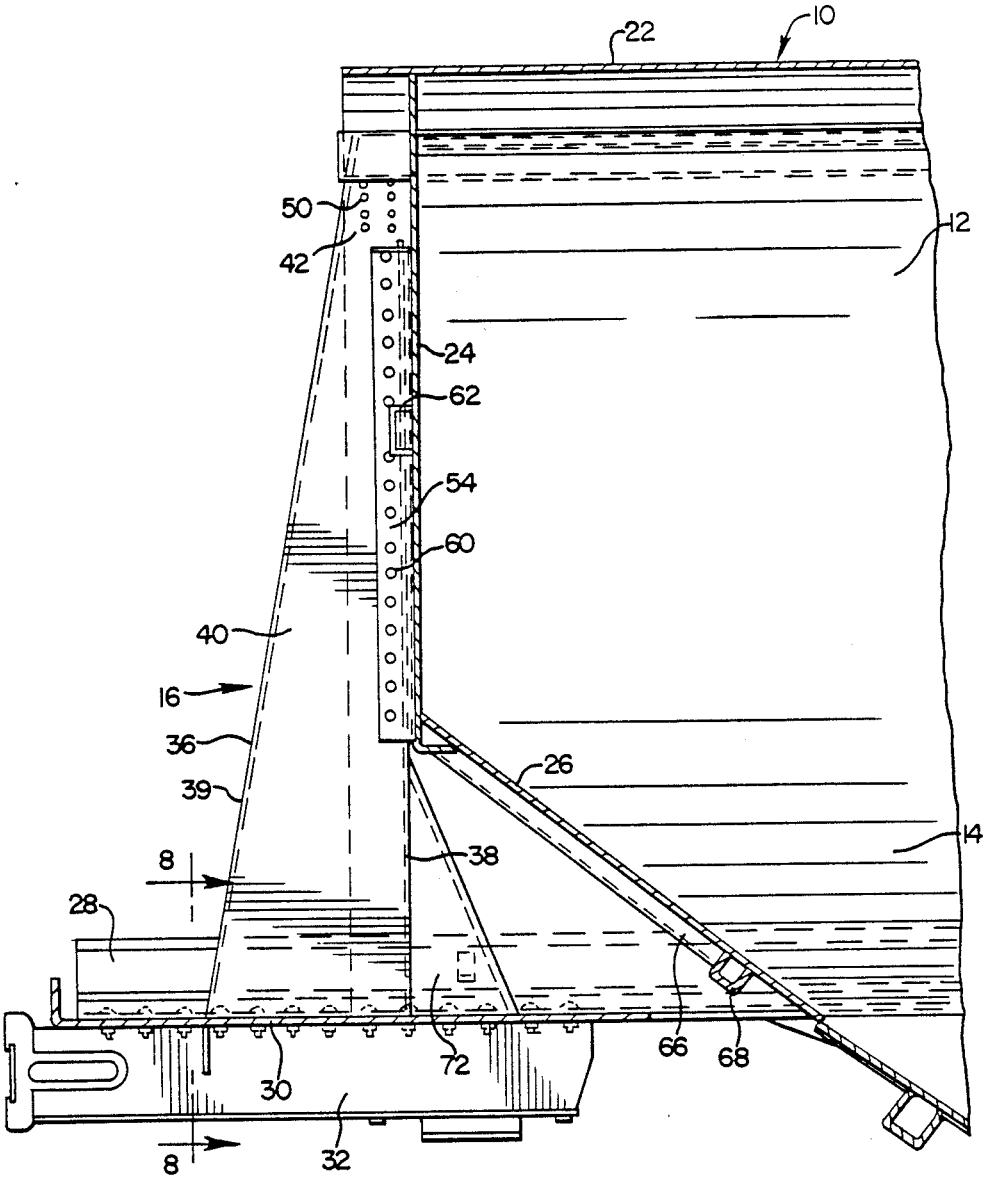
FIG. 4 is a cross-sectional view taken generally along the plane 4—4 in FIG. 3.

Body bolsters 34 are rigidly secured to the bottom of the side sills 28 and to center stub sill 32 so as to support one end of the car body 12 on trucks (not shown) in a well-known manner. A shear plate 30 extends between and is rigidly attached to the upper surfaces of the body bolsters 34 and the upper surface of the center stub sill 32. The lower surfaces of the side sills 28 are fastened to the upper surface of the shear plate 30 by two-piece fasteners extending therethrough. Shear plate 30 extends from a point outward of end slope sheet 26 to a short distance from the outer end of center stub sill 32, as best seen in FIG. 4. Shear plate 30, side sills 28, and center stub sill 32 extend outwardly beyond the end sheet 24. Body bolsters 34 are generally in transverse alignment with the end sheet 24.

Figure 5:
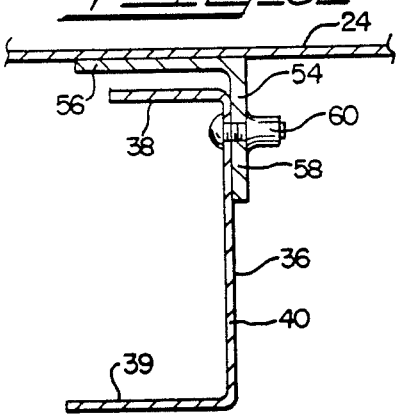
FIG. 5 is an enlarged cross-sectional view taken generally along the plane 5—5 in FIG. 3.
Figure 8:
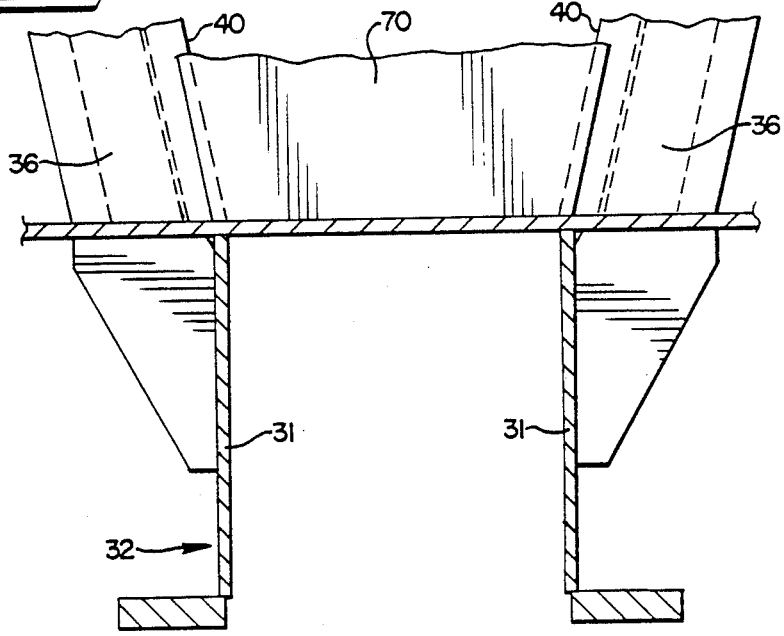
FIG. 8 is an enlarged cross-sectional view taken through the center stub sill assembly.

A pair of spaced-apart end stiffener members 36 extends between and is secured to the upper surface of shear plate 30 and to the end sheet 24 and a respective side sheet 18 and 20. Referring to FIGS. 3–6, end stiffener member 36 is preferably a channel-shaped member defined by side portions 38 and 39 and a web portion 40. As best seen in FIG. 5, web portion 40 is located perpendicular to end sheet 24 and has a depth that increases from the top toward the bottom thereof, as best seen in FIG. 4. Side portion 38 extends substantially parallel to end sheet 24 and is spaced a short distance therefrom. End stiffener members 36 are positioned so as to extend downwardly and inwardly from the upper portion of the corresponding side sheet 18 or 20 towards a portion of the shear plate 30 above the center stub sill 32, such that the lower end of web portion 40 is generally in alignment with the side walls 31 of center stub sill 32, as best seen in FIG. 8.

In accordance with the present invention, the steel end stiffener members 36 are connected to the aluminum body 12 by means of two-piece fasteners. The top portion of the end stiffener members 36 is secured to the end sheet and the adjacent side sheet and the intermediate portion of the end stiffener members 36 is preferably secured to the end sheet.

Figure 6:
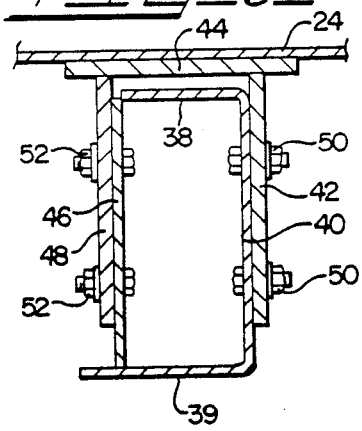
FIG. 6 is an enlarged cross-sectional view taken generally along the plane 6—6 in FIG. 3.
Figure 7:
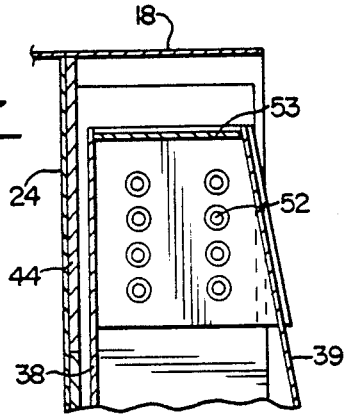
FIG. 7 is an enlarged cross-sectional view taken along the plane 7—7 in FIG. 3.

Referring to FIGS. 6 and 7, the upper portion of the web portion 40 of the end stiffener members 36 is attached to an aluminum connector plate 42, which plate in turn is welded to end plate 24 and an aluminum plate 44 welded to end sheet 24 and a respective side sheet 18 and 20. Web portion 40 is attached to connector plate 42 by a plurality of two-piece fasteners, such as nut and bolt assemblies 50 passing therethrough, as best seen in FIG. 6. A steel plate 46 is welded across the upper portions of side portions 38 and 39 of end stiffener members 36 at the outer edge of side portion 38 in facing relationship and spaced from web portion 40. Plate 46 is attached to an aluminum connector plate 48, which connector plate in turn is welded to end sheet 24 and plate 44. Plate 46 is attached to connector plate 48 by a plurality of two-piece fasteners, such as nut and bolt assemblies 52. Referring to FIG. 7, a steel plate 53 is welded between the uppermost portions of side portions 38 and 39 and web portion 40.

Figure 3:
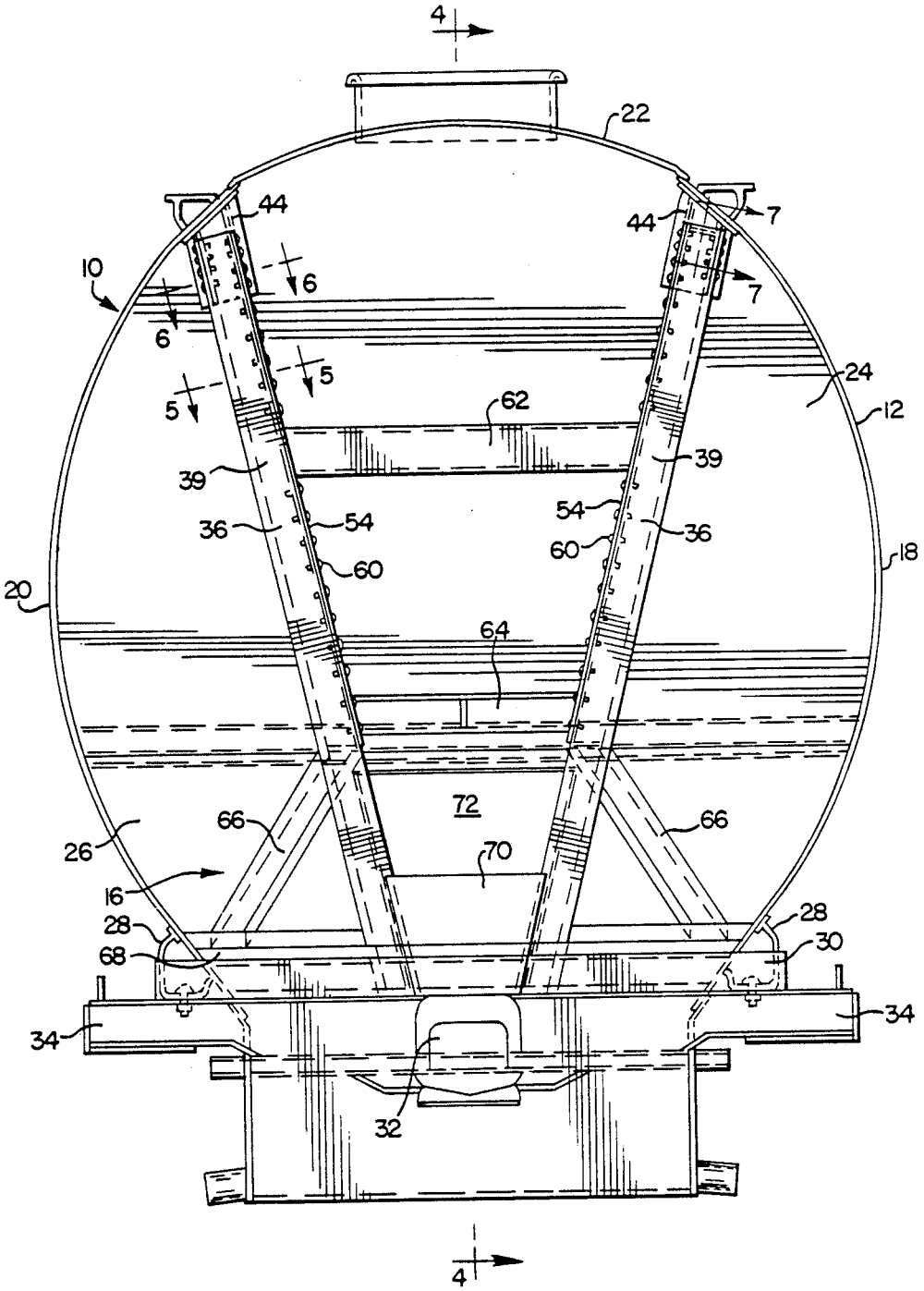
FIG. 3 is an enlarged end view of the railcar shown in FIG. 1.

Referring to FIGS. 3, 4 and 5, the intermediate portion of the end stiffener members is preferably attached to end sheet 24 through an aluminum angle member 54. Angle member 54 extends from the lower edge of connector plate 42 to the lower edge of end sheet 24 and is oriented generally parallel to web portion 40. Angle member 54 is defined by a leg portion 56 in facing contact with end sheet 24 and welded thereto and a leg portion 58 extending generally perpendicular to end sheet 24 and parallel to web portion 40. The intermediate portion of web portion 40 is attached to leg portion 58 along the entire length thereof by a plurality of spaced-apart two-piece fasteners, such as huckbolts 60, passing therethrough, as best seen in FIG. 5.

The lower end of end stiffener member 36 is welded to the upper surface of shear plate 30 such that the web portion thereof is substantially in vertical alignment with the side walls 31 of stub sill 32, as best seen in FIG. 8.

An aluminum channel stiffener member 62 preferably extends between the intermediate portions of end stiffener members 36 and is welded to end plate 24 and the angle members 54. A substantially horizontal steel reinforcing angle member 64 preferably extends between and is welded to the web portions 40 of the end stiffener members adjacent the lower ends of angle members 54. The end slope sheets 26 are preferably reinforced by aluminum channel stiffener members 66 welded thereto and extending downwardly and outwardly from a point adjacent the intersection between the end stiffener members 36 and the upper edge of end slope sheet 26 towards the lower outer edge of sheet 26 at horizontal aluminum channel stiffener member 68.

A trapezoidal-shaped plate 70 extends between and is welded to the lower portions of the side portions 39 of stiffener members 36. A trapezoidal-shaped plate 72 extends between and is welded to the lower portions of the side portions 38 of stiffener members 36. An end stiffener support assembly 72 is preferably provided to provide further support at the intersection between the end stiffener member 36 and the shear plate 30, as best seen in FIGS. 2 and 4.

It will be appreciated by those skilled in the art that the all-steel end structure 16, and the connection thereof to an aluminum railcar body, in accordance with the teachings of the invention, results in the utilization of high-strength steel in critical areas for sustaining coupler and vertical lading loads and aluminum for product containment where corrosion protection is needed. From the foregoing, it can be seen that there has been provided an aluminum railcar having an end structure that provides the necessary strength and minimizes the forces exerted on the welded aluminum components in the car body.

It will be readily observed from the foregoing detailed description of the invention and from the illustrated embodiment thereof that numerous variations and modifications may be effected without departing from the true spirit and scope of the novel concepts or principles of the invention.

What is claimed is:

1. In a railcar having an aluminum body portion comprising aluminum side sheets and aluminum end sheets, and a side sill secured to a lower marginal portion of each of said side sheets and extending lengthwise of the car; an improved steel end structure assembly connected to said aluminum body portion, comprising: a steel center stub sill assembly located generally on the longitudinal centerline of the body portion, steel body bolsters extending transversely of said body portion intermediate an outer end of said center stub sill assembly and the ends of said side sills; a steel shear plate supported on and attached to said body bolsters and said center stub sill; a pair of spaced-apart steel end stiffener members extending between and secured to the upper surface of said shear plate and to said end sheet and said side sheets; said end stiffener members having a depth that increases from the top toward the bottom thereof; said end stiffener members extending downwardly and inwardly from an upper portion of said side sheets towards a portion of said shear plate above said center stub sill assembly; said end stiffener members being secured at a top portion thereof to a first aluminum connector plate that is secured to said end sheet and said side sheet; said end stiffener members being secured at an intermediate portion thereof to an aluminum bracket member secured to said end sheet; and said bracket member being an elongated angle bracket member having a first leg portion in contact with and secured to said end sheet and a second leg portion in contact with and secured to said intermediate portion of said stiffener member.

2. The invention as defined in claim 1 wherein said second leg portion is substantially perpendicular to said end sheet and is bolted to said stiffener member.

3. The invention as defined in claim 1 wherein said end stiffener member is a channel-shaped member having a web portion oriented generally perpendicular to said end sheet and said second leg portion is secured to said web portion by a plurality of two-piece fastener means extending therethrough.

4. The invention as defined in claim 1 wherein a lower portion of said end stiffener member is welded to said shear plate.

5. The invention as defined in claim 1 wherein said end stiffener member is a channel-shaped member having a web portion, said web portion having a bottom end generally in vertical alignment with said center stub sill assembly.

6. The invention as defined in claim 1 wherein a plate member extends between and is secured to lower end portions of said end stiffener members.

7. The invention as defined in claim 1 wherein a channel-shaped aluminum stiffener member is secured to said end sheet and extends between said intermediate portions of said end stiffener members.

8. The invention as defined in claim 1 wherein said end stiffener member is a channel member having a web portion and a pair of spaced-apart side portions and said first connector plate is secured to said web portion by two-piece fastener means passing therethrough.

9. The invention as defined in claim 8 wherein said side portions have a steel plate extending therebetween and secured to the upper portions thereof.

10. The invention as defined in claim 9 wherein said steel plate is secured to a second aluminum connector plate by two-piece fastener means extending therethrough, and said second connector plate being secured to said end sheet and said side sheet.

11. The invention as defined in claim 10 wherein the upper edges of said first connector plate and said second connector plate are welded to a plate that is welded to said end sheet and said side sheet.

12. In a covered railway hopper car having an aluminum body portion defined by side sheets, a top sheet, and end sheets, a plurality of hoppers spaced at intervals along the length of the car including an end hopper at each end having an end hopper slope sheet extending downwardly and inwardly from a lower portion of one of said end sheets, and side sills secured to a lower marginal portion of each of said side sheets and extending lengthwise of the car; an improved steel end structure connected to said aluminum body portion, comprising: a steel center stub sill assembly located generally on the longitudinal centerline of the body portion; steel body bolsters extending transversely of said body portion intermediate an outer end of said center stub sill assembly and the ends of said side sills; a steel shear plate extending between and attached to an upper portion of said body bolsters; a pair of spaced-apart steel end stiffener members extending between and secured to an upper surface of said shear plate and to said end sheet and said side sheets; said end stiffener members having a depth that increases from the top towards the bottom thereof; said end stiffener members extending downwardly and inwardly from an upper portion of said side sheets towards a portion of said shear plate above said center stub sill assembly; said end stiffener members being secured at a top portion thereof to a first aluminum connector plate that is secured to said end sheet and said side sheet; said end stiffener members being secured at an intermediate portion thereof to an aluminum bracket member secured to said end sheet; and said bracket member being an elongated angle bracket member having a first leg portion in contact with and secured to said end sheet and a second leg portion in contact with and secured to said intermediate portion of said stiffener member.

13. The invention as defined in claim 12 wherein said top portion of said end stiffener member is secured to said first aluminum connector plate by two-piece fastener members extending therethrough.

14. The invention as defined in claim 13 wherein said end stiffener member is a channel member having a web portion extending between a pair of spaced-apart side portions, said web portion extending perpendicular to said end sheet.

15. The invention as defined in claim 14 wherein said web portion is secured to said first connector plates by two-piece fastener means passing therethrough.

16. The invention as defined in claim 15 wherein said side portions have a steel plate extending therebetween and secured to the upper portions thereof, said steel plate being secured to a second aluminum connector plate by two-piece fastener means extending therethrough, and said second connector plate being secured to said end sheet and said side sheet.

17. The invention as defined in claim 10 wherein the upper edges of said first connector plate and said second connector plate are welded to plate that is welded to said end sheet and said side sheet.

* * * * *